US010882312B2

(12) United States Patent
Nitta

(10) Patent No.: US 10,882,312 B2
(45) Date of Patent: Jan. 5, 2021

(54) LIQUID DISCHARGE APPARATUS AND METHOD FOR DRIVING THE SAME

(71) Applicant: TOSHIBA TEC KABUSHIKI KAISHA, Tokyo (JP)

(72) Inventor: Noboru Nitta, Tagata Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/549,039

(22) Filed: Aug. 23, 2019

(65) Prior Publication Data

US 2020/0070507 A1 Mar. 5, 2020

(30) Foreign Application Priority Data

Aug. 28, 2018 (JP) ..... 2018-159763

(51) Int. Cl.
*B41J 2/045* (2006.01)

(52) U.S. Cl.
CPC ..... *B41J 2/04541* (2013.01); *B41J 2/04573* (2013.01); *B41J 2/04581* (2013.01)

(58) Field of Classification Search
CPC ..... B41J 2202/15; B41J 2002/14459; B41J 2/04581; B41J 2/04573; B41J 2/04525; B41J 2/04526; B41J 2/04568; B41J 2/04513; B41J 2/04515; B41J 2/0451
See application file for complete search history.

(56) References Cited

U.S. PATENT DOCUMENTS

| | | | |
|---|---|---|---|
| 7,744,198 | B2 | 6/2010 | Iwao |
| 2007/0200885 | A1 | 8/2007 | Hibi |
| 2012/0281047 | A1 | 11/2012 | Barbet |
| 2016/0075132 | A1 | 3/2016 | Kitaoka et al. |

FOREIGN PATENT DOCUMENTS

| | | | |
|---|---|---|---|
| EP | 1506862 | A1 | 2/2005 |
| JP | 2013-091215 | A | 5/2013 |

OTHER PUBLICATIONS

Extended European Search Report dated Jan. 24, 2020, filed in counterpart European Patent Application No. 19193588.1, 8 pages.

*Primary Examiner* — Kristal Feggins
(74) *Attorney, Agent, or Firm* — Kim & Stewart LLP

(57) ABSTRACT

A liquid discharge apparatus includes a nozzle plate and a drive controller. The nozzle plate includes an array of nozzles arranged in a first direction and a plurality of actuators corresponding to the nozzles, respectively. The array includes first, second, and third nozzles arranged in the first direction. The actuators include first, second, and third actuators corresponding to the first, second, and third nozzles, respectively. The drive controller is configured to apply a drive signal to the first, second, third actuators during a drive cycle. The drive signal is applied to the first actuator at a timing different from a timing at which the drive signal is applied to the third actuator by an odd number multiple of a half of an inherent vibration cycle of the liquid discharge apparatus.

20 Claims, 14 Drawing Sheets

FIG. 9A
CHANNEL NUMBER
| | | | | | | | | | | | | | | | | | | | | | | | | | | |
|---|---|---|---|---|---|---|---|---|---|---|---|---|---|---|---|---|---|---|---|---|---|---|---|---|---|---|
| 1 | 9 | 17 | 25 | 33 | 41 | 49 | 57 | 65 | 73 | 81 | 89 | 97 | 105 | 113 | 121 | 129 | 137 | 145 | 153 | 161 | 169 | 177 | 185 | 193 | 201 | 209 |
| | 8 | 16 | 24 | 32 | 40 | 48 | 56 | 64 | 72 | 80 | 88 | 96 | 104 | 112 | 120 | 128 | 136 | 144 | 152 | 160 | 168 | 176 | 184 | 192 | 200 | 208 |
| | 7 | 15 | 23 | 31 | 39 | 47 | 55 | 63 | 71 | 79 | 87 | 95 | 103 | 111 | 119 | 127 | 135 | 143 | 151 | 159 | 167 | 175 | 183 | 191 | 199 | 207 |
| | 6 | 14 | 22 | 30 | 38 | 46 | 54 | 62 | 70 | 78 | 86 | 94 | 102 | 110 | 118 | 126 | 134 | 142 | 150 | 158 | 166 | 174 | 182 | 190 | 198 | 206 |
| | 5 | 13 | 21 | 29 | 37 | 45 | 53 | 61 | 69 | 77 | 85 | 93 | 101 | 109 | 117 | 125 | 133 | 141 | 149 | 157 | 165 | 173 | 181 | 189 | 197 | 205 | 213 |
| | 4 | 12 | 20 | 28 | 36 | 44 | 52 | 60 | 68 | 76 | 84 | 92 | 100 | 108 | 116 | 124 | 132 | 140 | 148 | 156 | 164 | 172 | 180 | 188 | 196 | 204 | 212 |
| | 3 | 11 | 19 | 27 | 35 | 43 | 51 | 59 | 67 | 75 | 83 | 91 | 99 | 107 | 115 | 123 | 131 | 139 | 147 | 155 | 163 | 171 | 179 | 187 | 195 | 203 | 211 |
| | 2 | 10 | 18 | 26 | 34 | 42 | 50 | 58 | 66 | 74 | 82 | 90 | 98 | 106 | 114 | 122 | 130 | 138 | 146 | 154 | 162 | 170 | 178 | 186 | 194 | 202 | 210 |
X
Y
FIG. 9B
VOLTAGE VALUE INDICATING MAGNITUDE OF PRESSURE (mV)
| | | | | | | | | | | | | | | | | | | | | | | | | | | |
|---|---|---|---|---|---|---|---|---|---|---|---|---|---|---|---|---|---|---|---|---|---|---|---|---|---|---|
| 5.1 | 6 | 8.3 | 12 | 13 | 15 | 17 | 14 | 12 | 10 | 6.1 | 2.8 | 1.7 | 1.3 | 1.6 | 1.8 | 3.1 | 3.9 | 11 | 12 | 14 | 14 | 11 | 10 | 8.3 | 4.6 | 2.4 |
| | 5.4 | 6.3 | 9.6 | 11 | 15 | 15 | 14 | 11 | 6.3 | 3.3 | 0.7 | -3 | -2 | 0.1 | -2 | -0 | 1.5 | 7 | 10 | 13 | 14 | 13 | 9.3 | 6.4 | 2.7 | 0.8 |
| | 5.1 | 5.5 | 8 | 10 | 12 | 13 | 12 | 9.1 | 3.6 | 0.3 | -1 | -1 | 7.2 | 7.7 | 1.5 | -4 | -1 | 1.2 | 8.8 | 11 | 12 | 11 | 8.7 | 6.4 | 1.8 | 0.9 |
| | 4.2 | 5.8 | 7.4 | 9.7 | 10 | 12 | 10 | 6.8 | 1 | -2 | -3 | 1.7 | 16 | 22 | 11 | -3 | -5 | -5 | 4.5 | 8.2 | 10 | 9.9 | 7.4 | 6.6 | 3 | 1.2 |
| | 4.8 | 4.5 | 6.4 | 9.4 | 9.4 | 10 | 8.3 | 3 | -1 | -5 | -5 | 3.5 | 37 | 88 | 26 | 1 | -7 | -5 | -0 | 5.2 | 7.7 | 9.8 | 7.3 | 7 | 4.1 | 2.1 | 3.9 |
| | 5.9 | 5.1 | 6.7 | 8.9 | 8.9 | 9.6 | 7.1 | 2.7 | -3 | -7 | -7 | 3.2 | 46 | | 48 | 2.6 | -9 | -9 | -3 | 2.8 | 6.4 | 8.8 | 7.3 | 7.1 | 5.1 | 3.9 | 5.9 |
| | 7 | 6.3 | 7.6 | 7.7 | 7 | 7.4 | 4.9 | 1.8 | -4 | -9 | -8 | -2 | 23 | 86 | 34 | 1.3 | -9 | -10 | -6 | 0.5 | 3.3 | 5.7 | 6.7 | 6.9 | 6.2 | 4.3 | 5.5 |
| | 8.5 | 8 | 8.3 | 8.2 | 6.6 | 6.7 | 3.3 | -0 | -6 | -9 | -7 | -7 | 10 | 23 | 18 | -1 | -9 | -9 | -7 | -2 | 2.2 | 3.5 | 5.3 | 6.1 | 6.9 | 5.5 | 6.5 |
FIG. 9C
WAVEFORM FOR MEASUREMENT
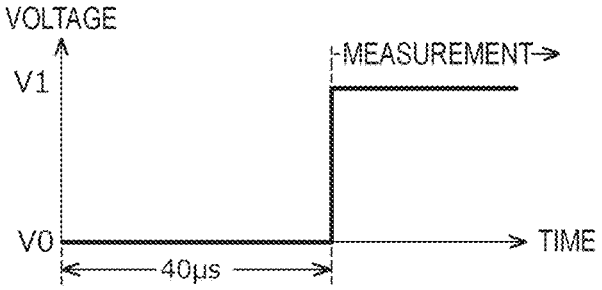
FIG. 10
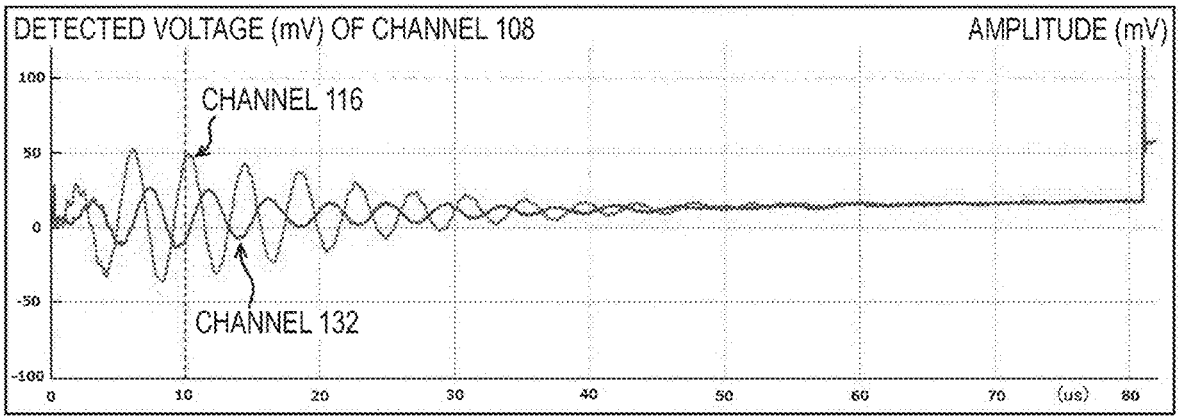

DRIVE TIMING

| | | | | | | | | | | | | | | | | | | | | | | | | | | | |
|---|---|---|---|---|---|---|---|---|---|---|---|---|---|---|---|---|---|---|---|---|---|---|---|---|---|---|---|
| D | A | B | C | D | A | B | C | D | A | B | C | D | A | B | C | D | A | B | C | D | A | B | C | D | A | B | |
| | B | C | D | A | B | C | D | A | B | C | D | A | B | C | D | A | B | C | D | A | B | C | D | A | B | C | |
| | C | D | A | B | C | D | A | B | C | D | A | B | C | D | A | B | C | D | A | B | C | D | A | B | C | D | |
| | D | A | B | C | D | A | B | C | D | A | B | C | D | A | B | C | D | A | B | C | D | A | B | C | D | A | |
| | A | B | C | D | A | B | C | D | A | B | C | D | A | B | C | D | A | B | C | D | A | B | C | D | A | B | C |
| | B | C | D | A | B | C | D | A | B | C | D | A | B | C | D | A | B | C | D | A | B | C | D | A | B | C | D |
| | C | D | A | B | C | D | A | B | C | D | A | B | C | D | A | B | C | D | A | B | C | D | A | B | C | D | A |
| | D | A | B | C | D | A | B | C | D | A | B | C | D | A | B | C | D | A | B | C | D | A | B | C | D | A | B |

DELAY AMOUNT (μs)

| | | | | | | | | | | | | | | | | | | | | | | | | | | | |
|---|---|---|---|---|---|---|---|---|---|---|---|---|---|---|---|---|---|---|---|---|---|---|---|---|---|---|---|
| 3 | 0 | 1 | 2 | 3 | 0 | 1 | 2 | 3 | 0 | 1 | 2 | 3 | 0 | 1 | 2 | 3 | 0 | 1 | 2 | 3 | 0 | 1 | 2 | 3 | 0 | 1 | |
| | 1 | 2 | 3 | 0 | 1 | 2 | 3 | 0 | 1 | 2 | 3 | 0 | 1 | 2 | 3 | 0 | 1 | 2 | 3 | 0 | 1 | 2 | 3 | 0 | 1 | 2 | |
| | 2 | 3 | 0 | 1 | 2 | 3 | 0 | 1 | 2 | 3 | 0 | 1 | 2 | 3 | 0 | 1 | 2 | 3 | 0 | 1 | 2 | 3 | 0 | 1 | 2 | 3 | |
| | 3 | 0 | 1 | 2 | 3 | 0 | 1 | 2 | 3 | 0 | 1 | 2 | 3 | 0 | 1 | 2 | 3 | 0 | 1 | 2 | 3 | 0 | 1 | 2 | 3 | 0 | |
| | 0 | 1 | 2 | 3 | 0 | 1 | 2 | 3 | 0 | 1 | 2 | 3 | 0 | 1 | 2 | 3 | 0 | 1 | 2 | 3 | 0 | 1 | 2 | 3 | 0 | 1 | 2 |
| | 1 | 2 | 3 | 0 | 1 | 2 | 3 | 0 | 1 | 2 | 3 | 0 | 1 | 2 | 3 | 0 | 1 | 2 | 3 | 0 | 1 | 2 | 3 | 0 | 1 | 2 | 3 |
| | 2 | 3 | 0 | 1 | 2 | 3 | 0 | 1 | 2 | 3 | 0 | 1 | 2 | 3 | 0 | 1 | 2 | 3 | 0 | 1 | 2 | 3 | 0 | 1 | 2 | 3 | 0 |
| | 3 | 0 | 1 | 2 | 3 | 0 | 1 | 2 | 3 | 0 | 1 | 2 | 3 | 0 | 1 | 2 | 3 | 0 | 1 | 2 | 3 | 0 | 1 | 2 | 3 | 0 | 1 |

LIQUID DISCHARGE APPARATUS AND METHOD FOR DRIVING THE SAME

CROSS-REFERENCE TO RELATED APPLICATIONS

This application is based upon and claims the benefit of priority from Japanese Patent Application No. 2018-159763, filed Aug. 28, 2018, the entire contents of which are incorporated herein by reference.

FIELD

Embodiments described herein relate generally to a liquid discharge apparatus and a method for driving the same method.

BACKGROUND

In the related art, there is known a liquid discharge apparatus for supplying a predetermined amount of liquid to a predetermined position. The liquid discharge apparatus is mounted on, for example, an ink jet printer, a 3D printer, a dispensing apparatus, or the like. An ink jet printer discharges an ink droplet from an ink jet head to form an image on a surface of a medium. A 3D printer discharges a droplet of a molding material from a molding material discharge head and hardens the droplet to form a three-dimensional molding. A dispensing apparatus discharges a droplet of a sample solution of a particular concentration to a plurality of containers or the like.

In a liquid discharge apparatus including a plurality of nozzles which discharge liquid when driven by an actuator, a plurality of actuators are driven at the same phase, or are driven at slightly shifted phase to avoid over concentration of the drive current. However, when the actuators are driven at approximately the same timing, ink discharge may become unstable due to crosstalk between the actuator operations which may interfere with each other.

DESCRIPTION OF THE DRAWINGS

FIG. 9A is a diagram in which the channel number for the channels arranged on the nozzle plate are displayed; FIG. 9B is a diagram depicting the magnitude of a pressure applied to a channel #108 from the other channels; and FIG. 9C depicts a step waveform used in the measurements depicted in FIG. 9B.

FIG. 10 is a graph illustrating a pressure waveform (residual vibration waveform) on the channel #108 when a channel #116 and a channel #132 are respectively driven.

DETAILED DESCRIPTION

Figure 1:
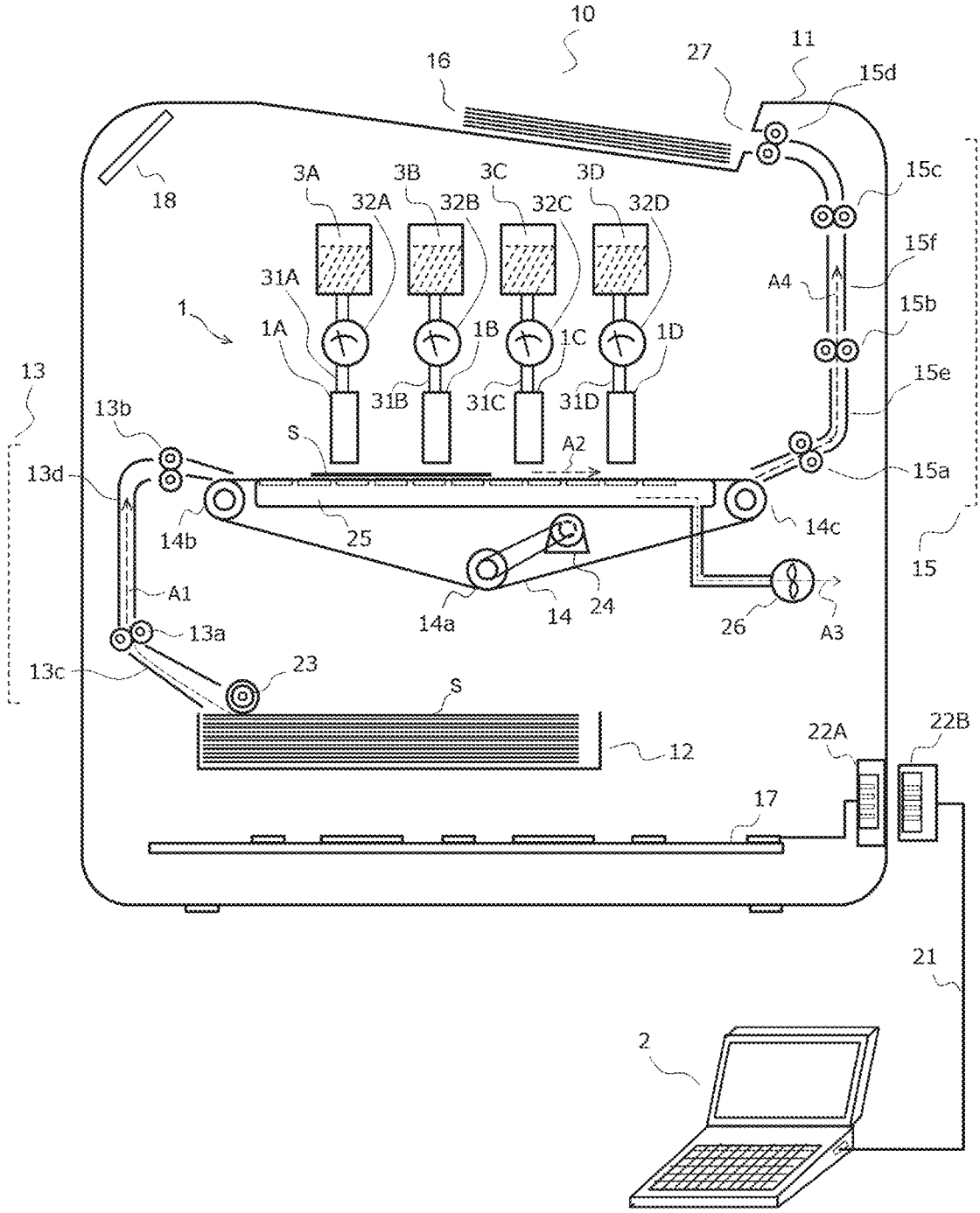
FIG. 1 illustrates a longitudinal cross-sectional view of an ink jet printer including a liquid discharge apparatus according to a first embodiment.

Embodiments provide a liquid discharge apparatus and a drive method capable of performing stable liquid discharge by suppressing crosstalk caused by interference of operations of actuators with each other.

According to an embodiment, a liquid discharge apparatus includes a nozzle plate and a drive controller. The nozzle plate includes an array of nozzles arranged in a first direction and a plurality of actuators corresponding to the nozzles, respectively. The nozzles include first, second, and third nozzles arranged in the first direction in this order. The plurality of actuators includes first, second, and third actuators corresponding to the first, second, and third nozzles, respectively. The drive controller is configured to apply a drive signal to the first, second, third actuators during a drive cycle. The drive signal is applied to the first actuator at a timing that is different from a timing at which the drive signal is applied to the third actuator by an odd number multiple of a half of an inherent vibration cycle of the liquid discharge apparatus.

Hereinafter, a liquid discharge apparatus and an image forming apparatus according to an embodiment will be described in detail with reference to the accompanying drawings. Further, in each drawing, the same aspect is denoted by the same reference numeral.

First Embodiment

An ink jet printer 10 for printing an image on a recording medium will be described as an example of an image forming apparatus on which a liquid discharge apparatus 1 according to an embodiment is mounted. FIG. 1 illustrates a schematic configuration of the ink jet printer 10. The ink jet printer 10 includes, for example, a box-shaped housing 11, which is an exterior body. Inside the housing 11, a cassette 12 for storing a sheet S, which is an example of the recording medium, an upstream conveying path 13 of the sheet S, a conveying belt 14 for conveying the sheet S taken out from the inside of the cassette 12, ink jet heads 1A to 1D for discharging an ink droplet toward the sheet S on the conveying belt 14, a downstream conveying path 15 of the sheet S, a discharge tray 16, and a control substrate 17 are disposed. An operation unit 18, which is a user interface, is disposed on the upper side of the housing 11.

Data of an image to be printed on the sheet S are generated by, for example, a computer 2 which is an external connection device. The image data generated by the computer 2 are sent to the control substrate 17 of the ink jet printer 10 through a cable 21 and connectors 22A and 22B.

A pickup roller 23 supplies the sheets S one by one from the cassette 12 to the upstream conveying path 13. The upstream conveying path 13 includes a pair of feed rollers 13*a* and 13*b* and sheet guide plates 13*c* and 13*d*. The sheet S is sent to an upper surface of the conveying belt 14 via the upstream conveying path 13. An arrow A1 in the drawing indicates a conveying path of the sheet S from the cassette 12 to the conveying belt 14.

The conveying belt 14 is a net-shaped endless belt formed with a large number of through holes on the surface thereof. Three rollers of a drive roller 14*a* and driven rollers 14*b* and 14*c* rotatably support the conveying belt 14. The motor 24 rotates the conveying belt 14 by rotating the drive roller 14*a*. The motor 24 is an example of a drive device. An arrow A2 in the drawing indicates a rotation direction of the conveying belt 14. A negative pressure container 25 is disposed on the back side of the conveying belt 14. The negative pressure container 25 is connected to a pressure reducing fan 26, and the inside thereof becomes a negative pressure due to an air flow generated by the fan 26. The sheet S is adsorbed and held on the upper surface of the conveying belt 14 by allowing the inside of the negative pressure container 25 to become the negative pressure. An arrow A3 in the drawing indicates the air flow.

The ink jet heads 1A to 1D are disposed to be opposite to the sheet S adsorbed and held on the conveying belt 14 with, for example, a narrow gap of 1 mm. The ink jet heads 1A to 1D respectively discharge ink droplets toward the sheet S. An image is formed on the sheet S when the sheet passes below the ink jet heads 1A to 1D. The ink jet heads 1A to 1D have the same structure except that the colors of ink to be discharged therefrom are different. The colors of the ink are, for example, cyan, magenta, yellow, and black.

The ink jet heads 1A to 1D are respectively connected to ink tanks 3A to 3D and ink supply pressure adjusting devices 32A to 32D via ink flow paths 31A to 31D. The ink flow paths 31A to 31D are, for example, resin tubes. The ink tanks 3A to 3D are containers for storing ink. The respective ink tanks 3A to 3D are respectively disposed above the ink jet heads 1A to 1D. In order to prevent the ink from leaking out from nozzles 51 (refer to FIG. 2) of the ink jet heads 1A to 1D during standby, each of the ink supply pressure adjusting devices 32A to 32D adjusts the inside of each of the ink jet heads 1A to 1D to a negative pressure, for example, −1 kPa with respect to an atmospheric pressure. At the time of image formation, the ink in each of the ink tanks 3A to 3D is supplied to each of the ink jet heads 1A to 1D by the ink supply pressure adjusting devices 32A to 32D.

After the image formation, the sheet S is sent from the conveying belt 14 to the downstream conveying path 15. The downstream conveying path 15 includes a pair of feed rollers 15*a*, 15*b*, 15*c*, and 15*d*, and sheet guide plates 15*e* and 15*f* for defining the conveying path of the sheet S. The sheet S is sent to the discharge tray 16 from a discharge port 27 via the downstream conveying path 15. An arrow A4 in the drawing indicates the conveying path of the sheet S.

A configuration of the ink jet head 1A will be described with reference to FIGS. 2 to 6. Since the ink jet heads 1B to 1D have the same structure as that of the ink jet head 1A, detailed descriptions thereof will be omitted.

Figure 2:
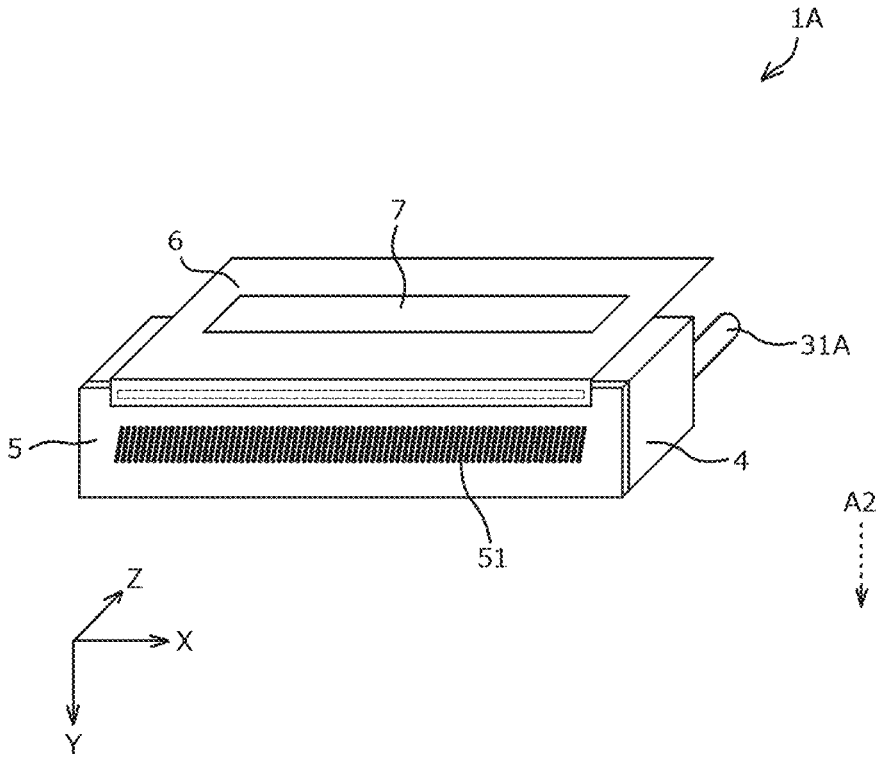
FIG. 2 illustrates a perspective view of an inkjet head.

FIG. 2 illustrates an external perspective view of the ink jet head 1A. The ink jet head 1A includes an ink supply unit 4, a nozzle plate 5, a flexible substrate 6, and a drive circuit 7. The plurality of nozzles 51 for discharging ink are arranged on the nozzle plate 5. The ink to be discharged from each nozzle 51 is supplied from the ink supply unit 4 communicating with the nozzle 51. The ink flow path 31A from the ink supply pressure adjusting device 32A is connected to the upper side of the ink supply unit 4. The drive circuit 7 is an example of a drive signal supply circuit. The arrow A2 indicates the rotation direction of the above-described conveying belt 14 (refer to FIG. 1).

Figure 3:
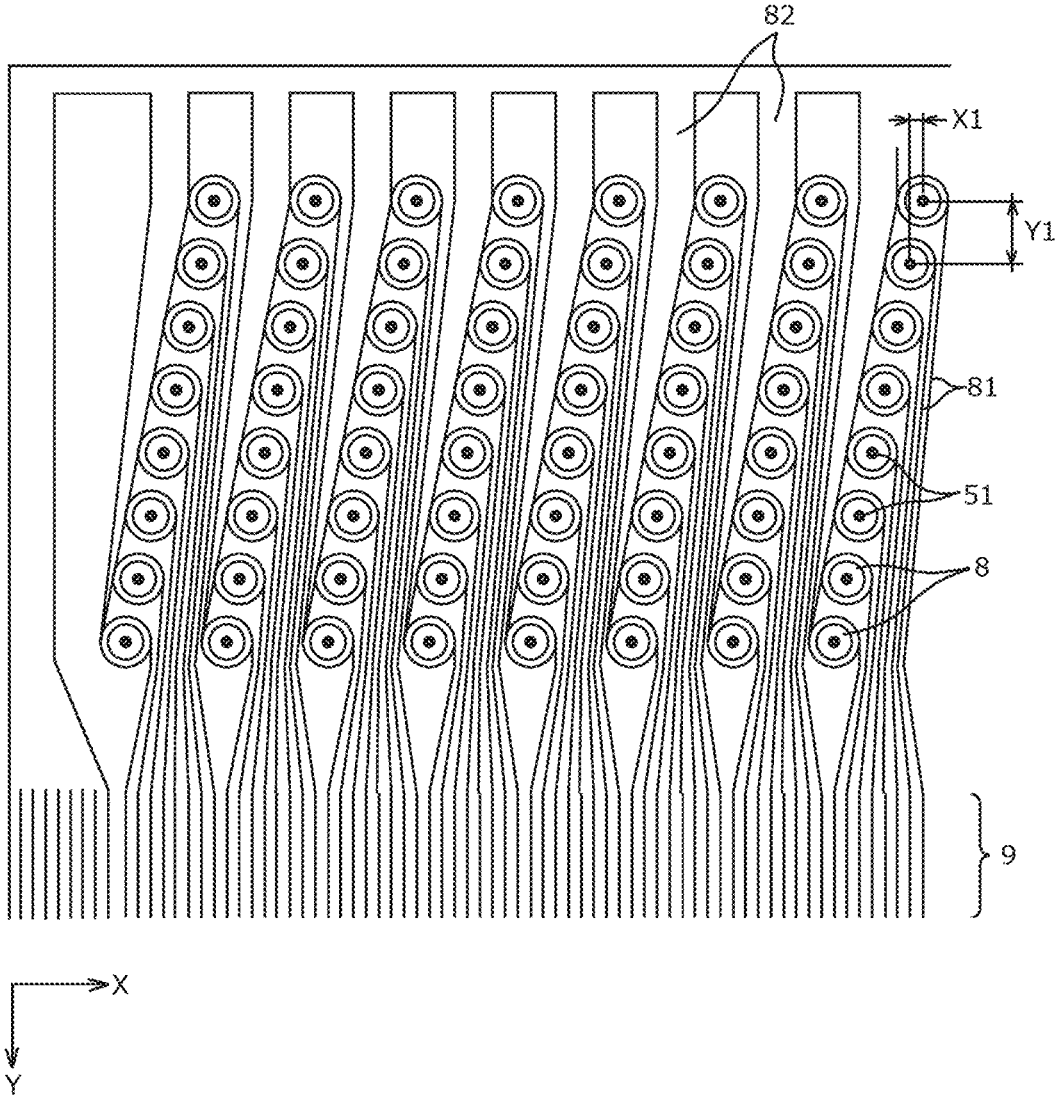
FIG. 3 illustrates a top plan view of a nozzle and an actuator arranged on a nozzle plate.

FIG. 3 illustrates a partially enlarged plan view of the nozzle plate 5. The nozzles 51 are two-dimensionally arranged in a column direction (an X-axis direction) and a row direction (a Y-axis direction). The nozzles 51 arranged in the row direction (the Y-axis direction) may be obliquely arranged so that the nozzles 51 do not overlap on the axial line of the Y axis. The respective nozzles 51 are arranged at a gap of a distance X1 in the X-axis direction and a gap of a distance Y1 in the Y-axis direction. As an example, the distance X1 is set to 42.4 μm and the distance Y1 is set to 250 μm. That is, the distance X1 is determined so that the recording density becomes 600 DPI in the X-axis direction. Further, the distance Y1 is determined based upon a relationship between a rotational speed of the conveying belt 14 and the time required for the ink to land so that printing is performed at 600 DPI in the Y-axis direction. The nozzles 51 are arranged such that 8 pieces of nozzles 51 arranged in the Y-axis direction as one set are plurally arranged in the X-axis direction. Although the illustration thereof is omitted, for example, 150 sets are arranged, and a total of 1,200 pieces of nozzles 51 are arranged.

An actuator 8 serving as a drive source of an operation of discharging the ink is provided for each nozzle 51. Each actuator 8 is formed in an annular shape and is arranged so that the nozzle 51 is positioned at the center thereof. One set of nozzles 51 and actuators 8 forms one channel. The size of the actuator 8 is, for example, 30 μm in an inner diameter and 140 μm in an outer diameter. Each actuator 8 is electrically connected to each an individual electrode 81. Further, in each actuator 8, 8 pieces of actuators 8 arranged in the Y-axis direction are electrically connected to each other by a common electrode 82. Each individual electrode 81 and each common electrode 82 are further electrically connected to a mounting pad 9. The mounting pad 9 is an input port that applies a drive signal (an electric signal) to the actuator 8. Each individual electrode 81 respectively applies the drive signal to each actuator 8, and each actuator 8 is driven according to the applied drive signal. In FIG. 3, for the convenience of description, the actuator 8, the individual electrode 81, the common electrode 82, and the mounting pad 9 are illustrated with a solid line, but the actuator 8, the individual electrode 81, the common electrode 82, and the mounting pad 9 are disposed inside the nozzle plate 5 (refer to a longitudinal cross-sectional view of FIG. 4).

The mounting pad 9 is electrically connected to a wiring pattern formed on the flexible substrate 6 via, for example, an anisotropic conductive film (ACF). Further, the wiring pattern of the flexible substrate 6 is electrically connected to the drive circuit 7. The drive circuit 7 is, for example, an integrated circuit (IC). The drive circuit 7 generates the drive signal to be applied to the actuator 8.

Figure 4:
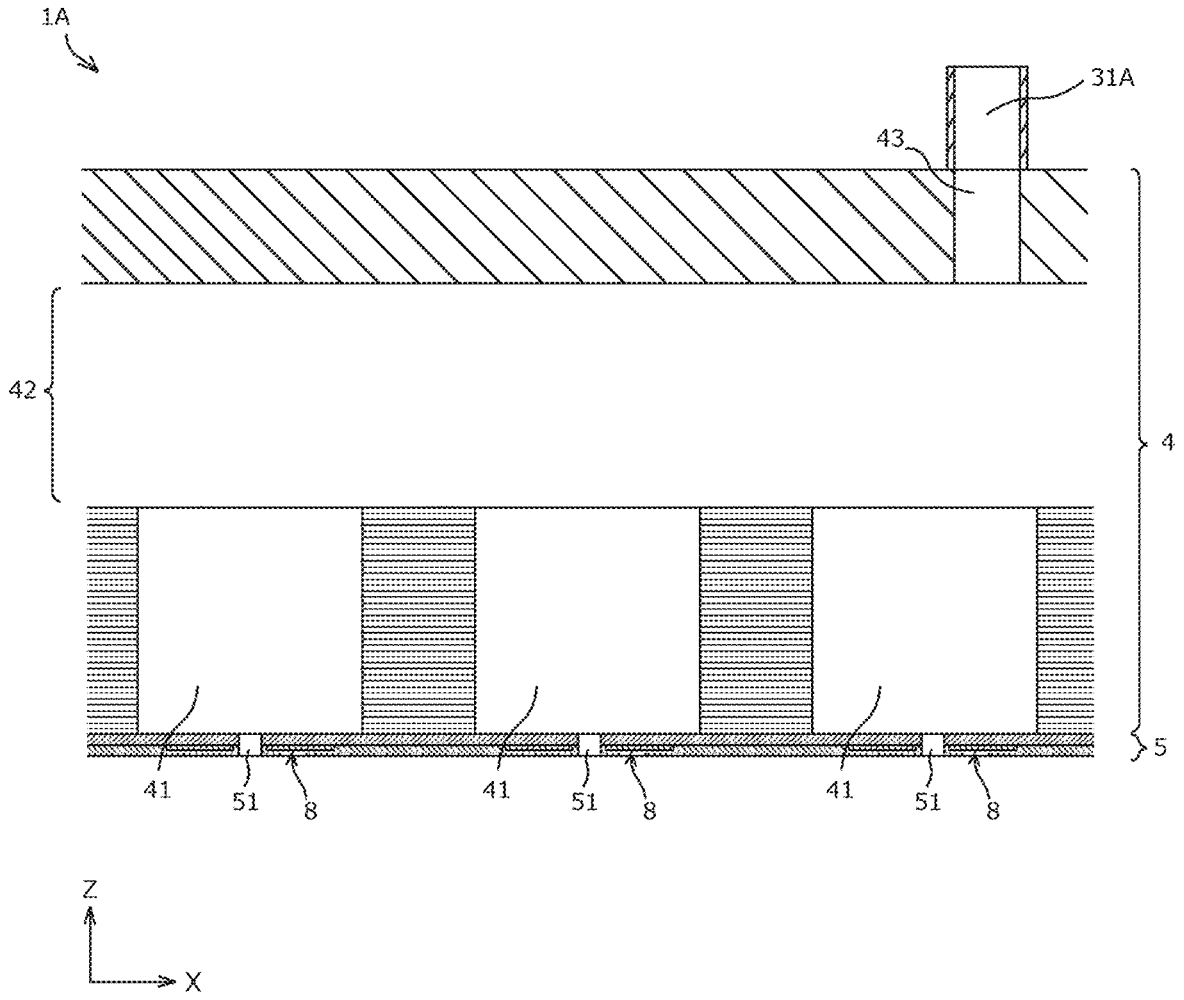
FIG. 4 illustrates a longitudinal cross-sectional view of the ink jet head.

FIG. 4 illustrates a longitudinal cross-sectional view of the ink jet head 1A. As illustrated in FIG. 4, the nozzle 51 penetrates the nozzle plate 5 in a Z-axis direction. The size of the nozzle 51 is, for example, 20 μm in diameter and 8 μm in length. A plurality of pressure chambers (individual pressure chambers) 41 respectively communicating with the nozzles 51 are provided inside the ink supply unit 4. The pressure chamber 41 is, for example, a cylindrical space with an opened upper part. The upper part of each pressure chamber 41 is open and communicates with a common ink chamber 42. The ink flow path 31A communicates with the common ink chamber 42 via an ink supply port 43. Each pressure chamber 41 and the common ink chamber 42 are filled with ink. For example, the common ink chamber 42 may be also formed in a flow path shape for circulating the ink. The pressure chamber 41 has a configuration in which, for example, a cylindrical hole having a diameter of 200 μm is formed on a single crystal silicon wafer having a thickness of 500 μm. The ink supply unit 4 has a configuration in which, for example, a space corresponding to the common ink chamber 42 is formed in alumina ($Al_2O_3$).

Figure 5:
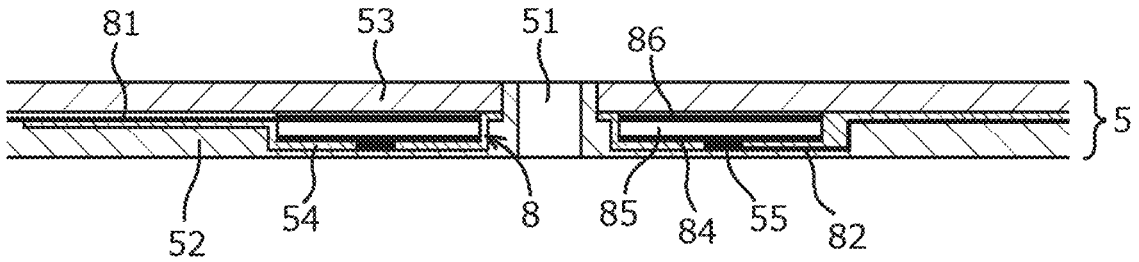
FIG. 5 illustrates a longitudinal cross-sectional view of the nozzle plate.

FIG. 5 illustrates a partially enlarged view of the nozzle plate 5. The nozzle plate 5 has a structure in which a protective layer 52, the actuator 8, and a diaphragm 53 are laminated in order from the bottom surface side. The actuator 8 has a structure in which a lower electrode 84, a thin plate-shaped piezoelectric body 85, and an upper electrode 86 are laminated. The upper electrode 86 is electrically connected to the individual electrode 81, and the lower electrode 84 is electrically connected to the common electrode 82. An insulating layer 54 for preventing a short circuit between the individual electrode 81 and the common electrode 82 is interposed at a boundary between the protective layer 52 and the diaphragm 53. The insulating layer 54 is formed of, for example, a silicon dioxide film ($SiO_2$) having a thickness of 0.5 μm. The lower electrode 84 and the common electrode 82 are electrically connected to each other through a contact hole 55 formed in the insulating layer 54. The piezoelectric body 85 is formed of, for example, lead zirconate titanate (PZT) having a thickness of 5 μm or less in consideration of a piezoelectric characteristic and a dielectric breakdown voltage. The upper electrode 86 and the lower electrode 84 are formed of, for example, platinum having a thickness of 0.15 μm. The individual electrode 81 and the common electrode 82 are formed of, for example, gold (Au) having a thickness of 0.3 μm.

The diaphragm 53 is formed of an insulating inorganic material. The insulating inorganic material is, for example, silicon dioxide ($SiO_2$). A thickness of the diaphragm 53 is, for example, 2 to 10 μm, desirably 4 to 6 μm. Although the details thereof will be described below, the diaphragm 53 and the protective layer 52 curve inwardly as the piezoelectric body 85 to which the voltage is applied is deformed in a $d_{31}$ mode. Then, when the application of the voltage to the piezoelectric body 85 is stopped, the shape of the piezoelectric body 85 is returned to the original state. The reversible deformation allows the volume of the pressure chamber (individual pressure chamber) 41 to expand and contract. When the volume of the pressure chamber 41 changes, an ink pressure in the pressure chamber 41 changes.

The protective layer 52 is formed of, for example, polyimide having a thickness of 4 μm. The protective layer 52 covers one surface on the bottom surface side of the nozzle plate 5, and further covers an inner peripheral surface of a hole of the nozzle 51.

Figure 6:
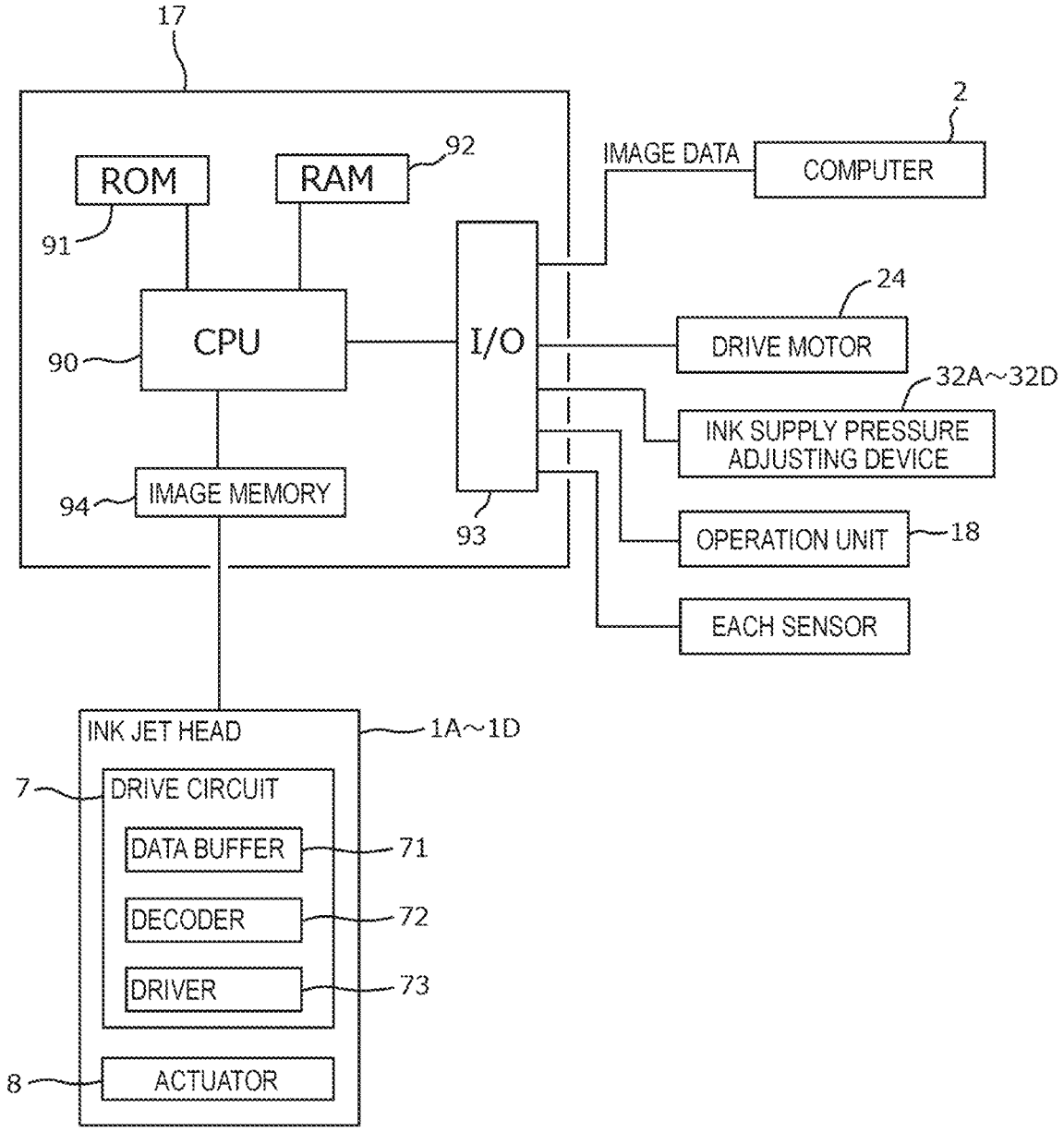
FIG. 6 is a block diagram of a control system.

FIG. 6 is a block diagram of the ink jet printer 10 illustrating functional components thereof. The control substrate 17 as a control unit is mounted with a CPU 90, a ROM 91, a RAM 92, an I/O port 93 which is an input and output port, and an image memory 94 thereon. The CPU 90 controls the drive motor 24, the ink supply pressure adjusting devices 32A to 32D, the operation unit 18, and various sensors through the I/O port 93. Print data from the computer 2 which is the external connection device are transmitted to the control substrate 17 through the I/O port 93, and then stored in the image memory 94. The CPU 90 transmits the print data stored in the image memory 94 to the drive circuit 7 in the order of drawing.

The drive circuit 7 includes a print data buffer 71, a decoder 72, and a driver 73. The print data buffer 71 stores the print data in time series for each actuator 8. The decoder 72 controls the driver 73 for each actuator 8 based upon the print data stored in the print data buffer 71. The driver 73 outputs a drive signal for operating each actuator 8 based upon the control of the decoder 72. The drive signal is a voltage to be applied to each actuator 8.

Figure 7:
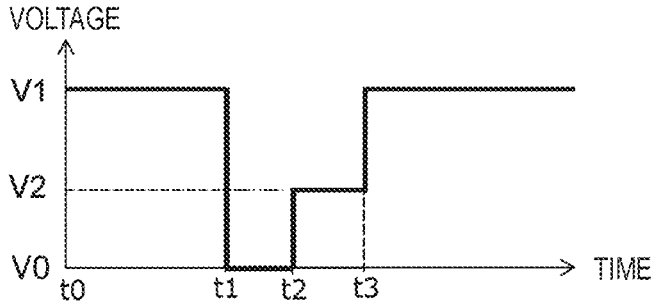
FIG. 7 illustrates a drive waveform for driving the actuator.

Next, a drive waveform of the drive signal applied to the actuator 8 and an operation of discharging the ink from the nozzle 51 will be described with reference to FIGS. 7 and 8A to 8E. FIG. 7 illustrates a single pulse drive waveform in which an ink droplet is dropped once in one drive cycle as an example of the drive waveform. The drive waveform of FIG. 7 is a so-called pull ejection drive waveform. However, the drive waveform is not limited to the single pulse. For example, a multi-drop waveform such as a double pulse, a triple pulse, and the like in which the ink droplet is dropped a plurality of times in one drive cycle may be used. Further, without being limited to the pull ejection drive waveform, push ejection and push-pull ejection may be used.

The drive circuit 7 applies a bias voltage V1 to the actuator 8 from time t0 to time t1. That is, the voltage V1 is applied between the upper electrode 86 and the lower electrode 84. Next, after a voltage V0 (=0 V) is applied from the time t1 when an ink discharge operation starts to time t2, a voltage V2 is applied from the time t2 to time t3, thereby discharging the ink droplets. After completing the discharge of the ink droplets, the bias voltage V1 is applied at the time t3, thereby damping a vibration in the pressure chamber 41. The voltage V2 is a voltage smaller than the bias voltage V1, and a voltage value is determined based upon, for example, a damping rate of the pressure vibration of the ink in the pressure chamber 41. Time from the time t1 to the time t2 and time from the time t2 to the time t3 are respectively set to a half cycle of an inherent vibration cycle λ determined by a characteristic of the ink and a structure in the head. A half cycle of the inherent vibration cycle λ is also referred to as an acoustic length (AL). Further, the voltage of the common electrode 82 is set to be constant at 0V during the series of operations. The inherent vibration cycle λ can be measured by detecting a change in impedance of the actuator 8 when the ink is filled therein. For example, an impedance analyzer is used for detecting the impedance. As another method of measuring the inherent vibration cycle λ, an electric signal such as a step waveform, and the like may be supplied from the drive circuit 7 to the actuator 8, and the vibration of the actuator 8 may be measured by a laser Doppler vibrometer. Further, the inherent vibration cycle λ can be obtained by computation through simulation using a computer.

Figure 8A:
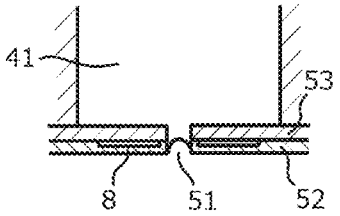
FIGS. 8A to 8E are explanatory diagrams illustrating an operation of the actuator.
Figure 8D:
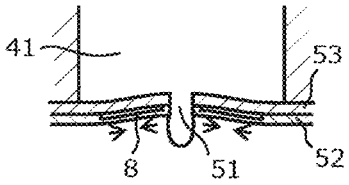
Figure 8B:
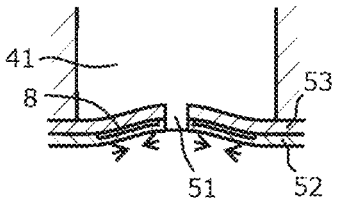

FIGS. 8A to 8E schematically illustrate an operation of discharging the ink by driving the actuator 8 with a drive signal having the waveform of FIG. 7. In a standby state, the pressure chamber 41 is filled with the ink. A meniscus position of the ink in the nozzle 51 is stopped at approximately zero as illustrated in FIG. 8A. Further, when the bias voltage V1 is applied as a contraction pulse from the time t0 to the time t1, an electric field is generated in the thickness direction of the piezoelectric body 85, and as illustrated in FIG. 8B, deformation of the $d_{31}$ mode is generated in the piezoelectric body 85. Specifically, the annular piezoelectric body 85 expands in the thickness direction and contracts in the radial direction. A compressive stress is generated in the diaphragm 53 and the protective layer 52 by the deformation of the piezoelectric body 85, however, since a compressive force generated in the diaphragm 53 is greater than a compressive force generated in the protective layer 52, the actuator 8 curves inwardly. That is, the actuator 8 is deformed to form a depression centered on the nozzle 51, whereby the volume of the pressure chamber 41 contracts.

Figure 8E:
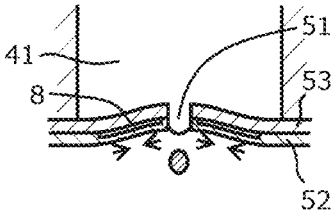
Figure 8C:
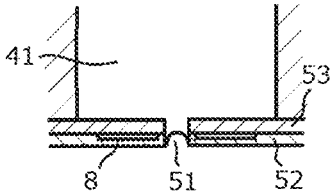

When the voltage V0 (=0 V) as an expansion pulse is applied at the time t1, the actuator 8 returns to the state before the deformation as schematically illustrated in FIG. 8C. At this time, the internal ink pressure decreases due to the returning of the volume to the original state in the pressure chamber 41, but the ink pressure increases since the ink is supplied from the common ink chamber 42 thereto. Thereafter, at the time t2, the ink supply to the pressure chamber 41 is stopped such that the increase of the ink pressure is also stopped. That is, the state thereof becomes a so-called pull state.

When the voltage V2 as a contraction pulse is applied at the time t2, the piezoelectric body 85 of the actuator 8 is deformed again such that the volume of the pressure chamber 41 contracts as schematically illustrated in FIG. 8D. As described above, the ink pressure increases between the time t1 and the time t2, and further the ink pressure increases by the pushing with the actuator 8 to decrease the volume of the pressure chamber 41, so that the ink is pushed out from the nozzle 51. The application of the voltage V2 continues up to the time t3, and the ink is discharged from the nozzle 51 as a droplet as schematically illustrated in FIG. 8E.

Continuously, at the time t3, the bias voltage V1 as a cancel pulse is applied. The ink pressure in the pressure chamber 41 decreases by discharging the ink. Further, the vibration of the ink remains in the pressure chamber 41. Therefore, the actuator 8 is driven so that the volume of the pressure chamber 41 contracts by applying the voltage V1 from the voltage V2, the ink pressure in the pressure chamber 41 is set to substantially zero, and the residual vibration of the ink in the pressure chamber 41 is forcibly suppressed.

Here, a characteristic of pressure vibrations transmitted to peripheral channels when the actuator 8 is driven will be described based upon a result of a test performed by using the ink jet head 1A in which 213 channels are two-dimensionally arranged on the nozzle plate 5. As described above, one channel is formed with a set of nozzles 51 and actuators 8. FIG. 9A indicates the channel numbers assigned to 213 channels arranged in the X and Y directions. Further, the channels arranged in the Y-axis direction are actually obliquely disposed as illustrated in FIG. 3. Further, hereinafter, for convenience of the description of a positional relationship between the channels, the positional relationship therebetween may be referred to as a left and right direction (X-axis direction), an up and down direction (Y-axis direction), and an oblique direction.

A distribution diagram of FIG. 9B is obtained by plotting the magnitude of a pressure applied to a channel #108 when, for example, the channel #108, which is one of the 213 channels, is in interest (hereinafter may be referred to as "focused channel") and other channels are individually driven. The channel is driven by applying a step waveform to the actuator 8. The step waveform is a waveform for measurement for contracting the actuator 8 only once as illustrated in FIG. 9C. Then, a measurement period is set after the contraction of the actuator 8. A numerical value in each frame of the distribution diagram illustrated in FIG. 9B indicates the magnitude of the pressure generated in the channel #108 when 10 μs has elapsed since the drive signal is applied to the channel to be driven. A positive value is a positive pressure and a negative value is a negative pressure. A voltage value (mV) of a piezoelectric effect generated in the piezoelectric body 85 of the actuator 8 of the channel #108 is measured as a value representing the magnitude of the pressure.

Referring to the distribution diagram of FIG. 9B, channels surrounding the periphery of the center of the channel #108 generate pressures in approximately the same direction with each other (a positive value range), and, on the other hand, channels surrounding the outer periphery of the channel #108 generate pressures in an approximately reversed direction (a negative value range). That is, a distance from the channel #108 to an area of the channel generating the reversed pressure corresponds to a half wavelength of the pressure vibration to be transmitted while spreading along the surface of the nozzle plate 5. That is, a half wavelength of the pressure vibration to be transmitted while spreading along the surface of the nozzle plate 5 is longer than a pitch (an adjacent distance) in the surface direction of the channel arranged on the nozzle plate 5. Therefore, the pressure vibrations of channels having a close positional relationship such as channels adjacent to each other, and the like are generally in the same phase.

Further, a waveform diagram in FIG. 10 respectively indicates a pressure waveform (a residual vibration waveform) appearing on the channel #108 when a channel #116 and a channel #132 are respectively driven. The channel #116 is adjacent to the first right side of the channel #108. The channel #132 is positioned on the third right side from the channel #108. In the pressure waveform (the residual vibration waveform), a vertical axis indicates a voltage value (mV) of the piezoelectric effect representing the magnitude of pressure and a horizontal axis indicates time (μs). Further, an inherent pressure vibration cycle λ of the ink jet head 10A is 4 μs, and the half cycle thereof (AL) is 2 μs. According to this result, it can be seen that the pressure applied to the focused channel varies in the magnitude and the phase depending on a location of the channel to be driven.

Figure 11:
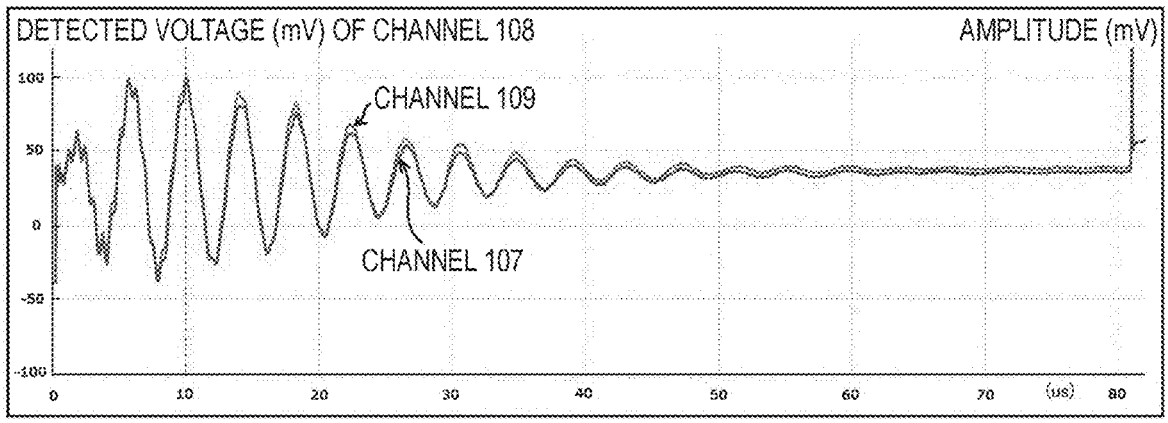
FIG. 11 is a graph illustrating a pressure waveform (residual vibration waveform) on the channel #108 when a channel #109 and a channel #107 are respectively driven.

On the other hand, a waveform diagram illustrated in FIG. 11 respectively indicates a pressure waveform (a residual vibration waveform) appearing on the channel #108 when a channel #109 and a channel #107 are respectively driven. The channel #109 is adjacent to the first upper side of the channel #108. The channel #107 is adjacent to the first lower side of the channel #108. According to this result, it can be seen that the pressure waveforms applied to the noted channel by the channels respectively adjacent to the first upper side of the focused channel and the first lower side thereof are similar to each other.

Figure 12:
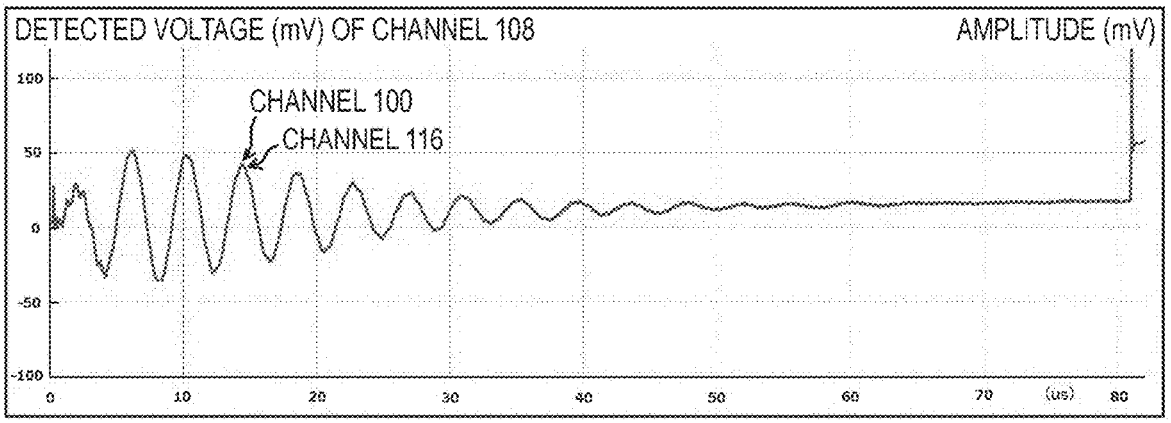
FIG. 12 is a graph illustrating a pressure waveform (residual vibration waveform) on the channel #108 when a channel #100 and a channel #116 are respectively driven.

A waveform diagram illustrated in FIG. 12 respectively indicates a pressure waveform (a residual vibration waveform) appearing on the channel #108 when a channel #100 and a channel #116 are respectively driven. The channel

#100 is adjacent to the first left side of the channel #108. The channel #116 is adjacent to the first right side of the channel #108. According to this result, it can be seen that the pressure waveforms applied to the focused channel by the channels respectively adjacent to the first left side of the channel and the first right side thereof almost coincide with each other.

Figure 13:
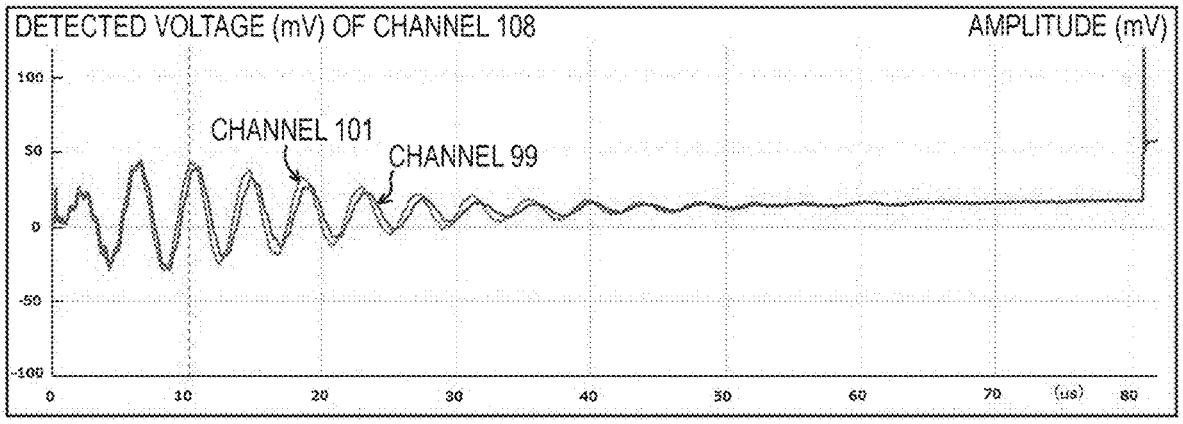
FIG. 13 is a graph illustrating a pressure waveform (residual vibration waveform) on the channel #108 when a channel #101 and a channel #99 are respectively driven.

A waveform diagram illustrated in FIG. 13 respectively indicates a pressure waveform (a residual vibration waveform) appearing on the channel #108 when a channel #101 and a channel #99 are respectively driven. The channel #101 is adjacent to the first upper left side of the channel #108. The channel #99 is adjacent to the first lower left side of the channel #108. According to this result, it can be seen that the pressure waveforms applied to the channel by the channels respectively adjacent to the obliquely first upper left side of the focused channel and the obliquely first lower left side thereof are also similar to each other.

Figure 14:
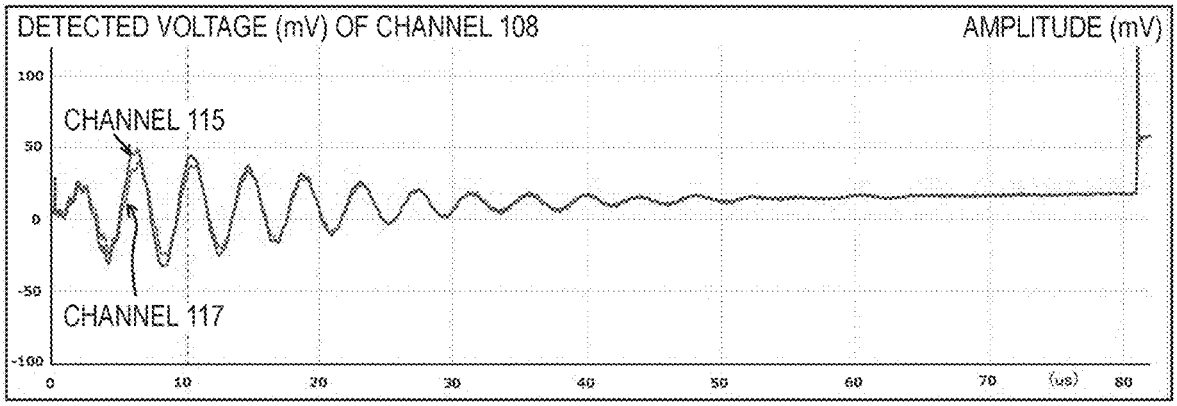
FIG. 14 is a graph illustrating a pressure waveform (residual vibration waveform) on the channel #108 when a channel #117 and a channel #115 are respectively driven.

A waveform diagram illustrated in FIG. 14 respectively indicates a pressure waveform (a residual vibration waveform) appearing on the channel #108 when a channel #117 and a channel #115 are respectively driven. The channel #117 is adjacent to the first upper right side of the channel #108. The channel #115 is adjacent to the first lower right side of the channel #108. According to this result, it can be seen that the pressure waveforms applied to the focused channel by the channels respectively adjacent to the obliquely first upper right side of the channel and the obliquely first lower right side thereof are also similar to each other.

According to the results illustrated in FIGS. 9A to 14, it can be seen that the channels disposed at symmetrical positions when viewed from the focused channel apply approximately the same pressure vibrations to the focused channel. That is, the channels adjacent to the focused channel on the left and right sides (in the X-axis direction) when viewed from the focused channel, the channels adjacent thereto on the upper and lower sides (in the Y-axis direction) when viewed from the focused channel, and the channels adjacent thereto on the obliquely upper and obliquely lower sides when viewed from the noted channel are present at symmetrical positions when viewed from the focused channel, and apply approximately the same pressure vibrations to the focused channel.

Figure 15:
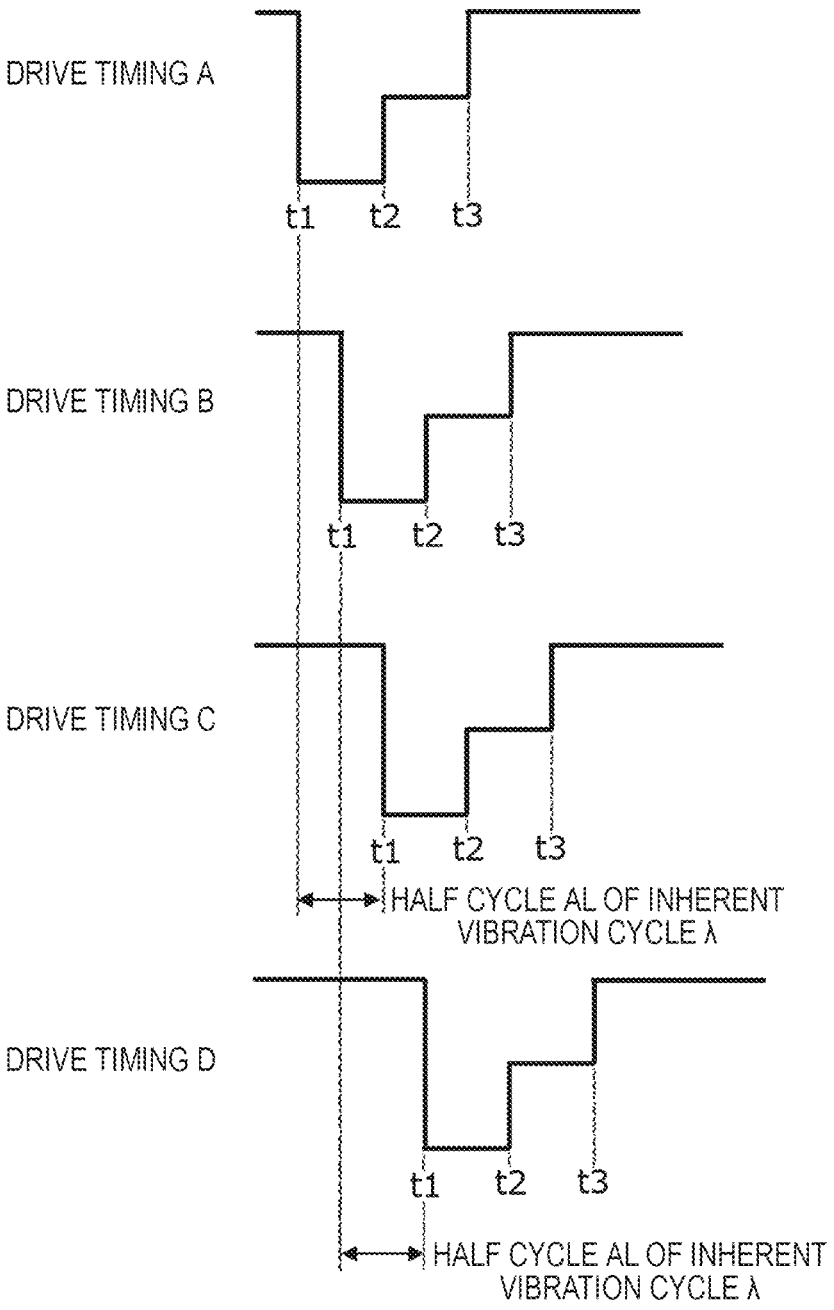
FIG. 15 is an explanatory diagram illustrating four drive timings A to D in which time differences (delay times) are mutually set to the drive waveforms for driving the channels.

Based upon the results described above, as illustrated in FIG. 15, four drive timings A to D in which time differences (delay times) are provided to the drive waveforms applied to the plurality of actuators 8 are prepared. A delay time between the drive waveform of the drive timing A and the drive waveform of the drive timing C is set to be a half cycle AL of the inherent pressure vibration cycle λ (one half of λ). Further, a delay time between the drive waveform of the drive timing B and the drive waveform of the drive timing D is set to be a half cycle AL of the inherent pressure vibration cycle λ (one half of λ).

Further, when the delay time is set as described above, a delay time between the drive waveform of the drive timing A and the drive waveform of the drive timing B becomes one quarter cycle of the inherent pressure vibration cycle λ (one quarter of λ). A delay time between the drive waveform of the drive timing A and the drive waveform of the drive timing D becomes three-quarter cycle of the inherent pressure vibration cycle λ (three quarters of λ). A delay time between the drive waveform of the drive timing B and the drive waveform of the drive timing C becomes one quarter cycle of the inherent pressure vibration cycle λ (one quarter of λ).

Figures 16A, 16B:
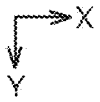
FIGS. 16A and 16B illustrate a matrix in which the drive timings A to D are regularly assigned to all the channels, and a matrix indicating a distribution of the delay time of each channel.

Next, as one example illustrated in FIG. 16A, the drive timings A to D are regularly assigned to all the channels. That is, channels adjacent to a channel to which the drive timing A is assigned on both the left and right sides thereof and on both the upper and lower sides thereof are set to be a combination of the respective drive timing B and the drive timing D; and channels adjacent thereto on the upper left and lower left sides thereof and on the upper right and lower right sides thereof are set to be a combination of the respective drive timing A and the drive timing C.

Channels adjacent to a channel to which the drive timing B is assigned on both the left and right sides thereof and on both the upper and lower sides thereof are set to be a combination of the respective drive timing A and the drive timing C; and channels adjacent thereto on the upper left and lower left sides thereof and on the upper right and lower right sides thereof are set to be a combination of the respective drive timing B and the drive timing D.

Channels adjacent to a channel to which the drive timing C is assigned on both the left and right sides thereof and on both the upper and lower sides thereof are set to be a combination of the respective drive timing B and the drive timing D; and channels adjacent thereto on the upper left and lower left sides thereof and on the upper right and lower right sides thereof are set to be a combination of the respective drive timing A and the drive timing C.

Channels adjacent to a channel to which the drive timing D is assigned on both the left and right sides thereof and on both the upper and lower sides thereof are set to be a combination of the respective drive timing A and the drive timing C; and channels adjacent thereto on the upper left and lower left sides thereof and on the upper right and lower right sides thereof are set to be a combination of the respective drive timing B and the drive timing D. Further, in the case of a channel disposed at a corner, channels adjacent to one of the upper and lower sides and one of the left and right sides become targets.

When the channel to which the drive timing A is assigned becomes the focused channel, since the drive timings of the channels adjacent to the focused channel on both the left and right sides are the drive timing B and the drive timing D, the phases of the pressure vibrations from the channels adjacent thereto on both the left and right sides are shifted by the half cycle AL of the inherent vibration cycle λ. The same also applies to the channels adjacent thereto on both the upper and lower sides. Since the drive timings of the channels adjacent thereto on the upper left and lower left sides are the drive timing A and the drive timing C, the phases of the pressure vibrations from the channels adjacent thereto on the upper left and lower left sides are shifted by the half cycle AL of the inherent vibration cycle λ. The same also applies to the channels adjacent thereto on the upper right and lower right sides.

When the channel to which the drive timing B is assigned becomes the focused channel, since the drive timings of the channels adjacent to the focused channel on both the left and right sides are the drive timing A and the drive timing C, the phases of the pressure vibrations from the channels adjacent thereto on both the left and right sides are shifted by the half cycle AL of the inherent vibration cycle λ. The same also applies to the channels adjacent thereto on both the upper and lower sides. Since the drive timings of the channels adjacent thereto on the upper left and lower left sides are the drive timing B and the drive timing D, the phases of the pressure vibrations from the channels adjacent thereto on the upper left and lower left sides are shifted by the half cycle AL of the inherent vibration cycle λ. The same also applies to the channels adjacent thereto on the upper right and lower right sides.

When the channel to which the drive timing C is assigned becomes the focused channel, since the drive timings of the channels adjacent to the focused channel on both the left and right sides are the drive timing B and the drive timing D, the phases of the pressure vibrations from the channels adjacent thereto on both the left and right sides are shifted by the half cycle AL of the inherent vibration cycle λ. The same also applies to the channels adjacent thereto on both the upper and lower sides. Since the drive timings of the channels adjacent thereto on the upper left and lower left sides are the drive timing A and the drive timing C, the phases of the pressure vibrations from the channels adjacent thereto on the upper left and lower left sides are shifted by the half cycle AL of the inherent vibration cycle λ. The same also applies to the channels adjacent thereto on the upper right and lower right sides.

When the channel to which the drive timing D is assigned becomes the focused channel, since the drive timings of the channels adjacent to the focused channel on both the left and right sides are the drive timing A and the drive timing C, the phases of the pressure vibrations from the channels adjacent thereto on both the left and right sides are shifted by the half cycle AL of the inherent vibration cycle λ. The same also applies to the channels adjacent thereto on both the upper and lower sides. Since the drive timings of the channels adjacent thereto on the upper left and lower left sides are the drive timing B and the drive timing D, the phases of the pressure vibrations from the channels adjacent thereto on the upper left and lower left sides are shifted by the half cycle AL of the inherent vibration cycle λ. The same also applies to the channels adjacent thereto on the upper right and lower right sides.

As described above, the inherent pressure vibration cycle λ of the ink jet head 1A used is 4 μs and the half cycle AL is 2 μs. Accordingly, when the drive timing of each channel is represented by a delay amount, the delay amount is represented as illustrated in FIG. 16B. Numerical values 0, 1, 2, and 3 in the frame respectively correspond to the drive timings A, B, C, and D. Since the drive timing A is set as a reference (=0), the drive timings B, C, and D are respectively set to the delay amounts of 1 μs, 2 μs, and 3 μs from the drive timing A. Further, even though any one of the channels becomes the focused channel, when the channels therearound are noted, the channels adjacent to the focused channel on both the left and right sides, adjacent thereto on both the upper and lower sides, adjacent thereto on the upper left and lower left sides, and adjacent thereto on the upper right and lower right sides are set to be driven at the drive timing mutually shifted by 2 μs.

That is, even though any one of the channels becomes the focused channel from among the 213 channels to which the drive timings A to Dare assigned, the channels respectively adjacent to each other in the left and right direction, in the up and down direction, and in the oblique direction (excluding the diagonal) are set to be driven by the drive waveforms of mutually reversed phases. As described above, the channels adjacent to each other in the left and right direction, in the up and down direction, and in the oblique direction (excluding the diagonal) are channels disposed at symmetrical positions when viewed from the focused channel. The channels disposed at the symmetrical positions provide the pressure vibrations of approximately the same or similar waveform to the focused channel. Therefore, when both channels are driven at the same timing (in the same phase), the mutual vibrations are added and amplified pressure vibration is applied to the focused channel, however, the both channels are driven by the drive waveforms of the reversed phases by shifting the drive timing by a half cycle, whereby the pressure vibrations of the reversed phase in which the vibrations cancel each other out are applied to the focused channel. As a result, when the plurality of channels is driven, influences from the peripheral channels may hardly occur, thereby making it possible to perform stable ink discharge.

FIG. 16A illustrates an example of the drive timings A to D assigned to 213 channels. Even in the case of 213 channels or more, it is possible to perform the stable discharge by assigning the drive timings A to D thereto with the same regularity.

Figure 17:
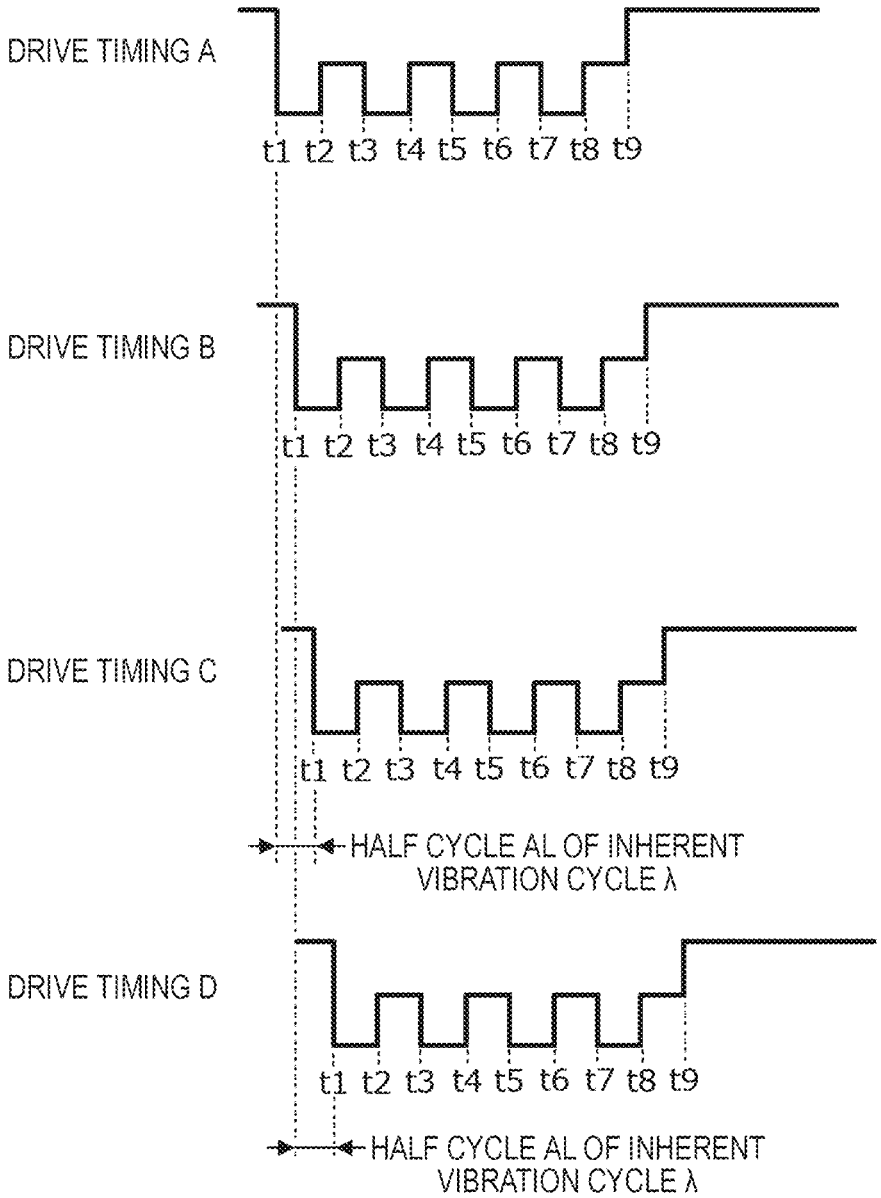
FIG. 17 is an explanatory diagram illustrating another example of the drive waveform for driving the channel.

The drive waveform may be a multi-drop waveform in which small drops of a plurality of droplets are discharged while forming one dot. The drive waveform illustrated in FIG. 17 is an example of the multi-drop waveform in which small drops of four droplets are discharged while forming one dot. The discharge of each small drop is performed from the timing at which the voltage V2 is applied to the actuator 8 at the time t2, t4, t6, and t8 as a starting point. The time from time t1 to time t2, the time from time t2 to time t3, the time from time t3 to time t4, the time from time t4 to time t5, the time from time t5 to time t6, the time from time t6 to time t7, the time from time t7 to time t8, and the time from time t8 to time t9 are respectively set to the half cycle (AL) of inherent vibration cycle λ. Further, FIG. 17 illustrates four drive timings A to D in which time differences (delay times) are mutually provided to the respective drive waveforms. The drive timing C is delayed by the half cycle (AL) with respect to the drive timing A. The drive timing D is delayed by the half cycle (AL) with respect to the drive timing B. Therefore, the drive timing A and the drive timing C of the multi-drop waveform are driven in the reversed phase every time each small drop is discharged. The drive timing B and the drive timing D of the multi-drop waveform are driven in the reversed phase every time each small drop is discharged. Therefore, in the multi-drop waveform, pressure propagation is more effectively cancelled.

Further, it is desirable that the drive waveforms of mutually reversed phases are used, and the time (the delay time) for shifting the drive timing is not limited to the half cycle (1AL). The time therefor may be an odd number multiple of the half cycle AL.

Further, in the above-described embodiment, the channels adjacent to the focused channel on both the left and right sides, adjacent thereto on both the upper and lower sides, adjacent thereto on the upper left and lower left sides, and adjacent thereto on the upper right and lower right sides are set to be driven in the mutually reversed phase. However, the channels to be driven in the reversed phase may be desirably in the symmetrical positional relationship in which the vibrations cancel out, and are not limited to the positional relationship between both the left and right sides, both the upper and lower sides, the upper left and the lower left sides, and the upper right and the lower right sides. For example, channels adjacent to the focused channel on the upper left and upper right sides, channels adjacent thereto on the lower left and lower right sides, channels diagonally adjacent thereto on the upper left and lower right sides, and channels diagonally adjacent thereto on the lower left and upper right sides may be driven in the mutually reversed phases.

Further, as long as channels are in the symmetrical positional relationship in which the vibrations thereof cancel out, the channels are not limited to being directly adjacent to the focused channel. That is, the second or more channels away from the channel may be used. As an example of the left and right direction, the second channel on the left side of the focused channel and the second channel on the right side thereof are set to be driven in the mutually reversed phases. Further, the number of channels away from the focused channel may not necessarily be the same as each other. As an example of the left and right direction, for example, the second channel on the left side of the focused channel and the third channel on the right side thereof may be set to be driven in the mutually reversed phases. Further, the channels driven in the reversed phases may not be a pair of one to one. A pair of one-to-two, for example one channel adjacent to the focused channel on the left side and channels adjacent thereto on the upper right and lower right sides, may be used. The directions thereof are not limited to the left and right direction, and the same also applies to the up and down direction and the oblique direction.

That is, a drive timing determination method as to how to select the channel to be driven by the drive waveform of the reversed phase may acquire the distribution diagram as shown in FIG. 9B by performing a test or a simulation by a computer, and the like, and may select at least one set of channels from among channels that apply the pressures of the same phase centering on the focused channel. However, a channel within a range shorter than the wavelength of the vibration along the surface direction of the nozzle plate 5 is selected. In the case of the distribution diagram in FIG. 9B, when viewed from the focused channel 108, the channels (positive values) that apply the pressures of the same phase exist around the focused channel 108, and the channels (negative values) that apply the pressures of the reversed phase exist at the outer periphery thereof. Further, the channel (the positive value) that applies the pressure of the same phase also exists at the outer periphery thereof, however, the channel to be driven by the drive waveform of the reversed phase is selected from among the channels that apply the pressures of the same phase positioned further to the inside than the channels that apply the pressures of the reversed phase.

As another example of the drive timing determination method, for example, the channel to be driven is set as the focused channel, and the wavelength of the vibration to be transmitted in the surface direction when the focused channel is driven is confirmed by a test or a simulation. Next, on the basis of the result thereof, at least one set of channels to be driven by the drive waveforms of the reversed phase is selected from among the channels to which the pressures of the same phase are transmitted. That is, the drive timing determination method using FIG. 9B is a method of driving a channel other than the focused channel, and the latter one is a method of driving the focused channel itself.

Second Embodiment

Figure 18:
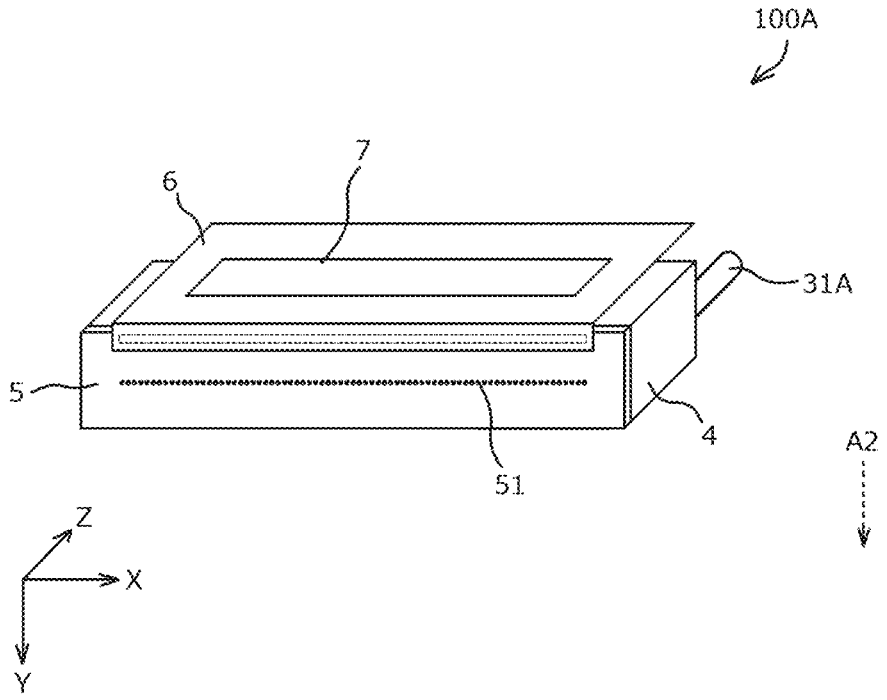
FIG. 18 illustrates a perspective view of an inkjet head which is an example of a liquid discharge apparatus according to a second embodiment.

A liquid discharge apparatus according to a second embodiment will be described. FIG. 18 illustrates a perspective view of an ink jet head 100A as an example of the liquid discharge apparatus according to the second embodiment. The ink jet head 100A has the same configuration as that of the ink jet head 1A illustrated according to the first embodiment except that the nozzles 51 are arranged in a single row. Accordingly, the same components as those of FIG. 2 are denoted by the same reference signs, and the detailed descriptions thereof will be omitted.

As illustrated in FIG. 18, in the ink jet head 100A, the nozzles 51 forming channels are arranged in a single row in the X direction. Then, as one example illustrated in FIG. 19A, the drive timings A to D are regularly assigned to each channel. FIG. 19B shows a delay amount of the drive timing of each channel in time. In the ink jet head 100A according to the second embodiment, when the channel to which the drive timing A is assigned becomes the focused channel, since the drive timings of the channels adjacent to the focused channel on both the left and right sides are the drive timing B and the drive timing D, the phases of the pressure vibrations of the channels adjacent thereto on both the left and right sides are shifted by a half cycle. When the channel to which the drive timing B is assigned becomes the focused channel, since the drive timings of the channels adjacent thereto on both the left and right sides are the drive timing A and the drive timing C, the phases of the pressure vibrations of the channels adjacent thereto on both the left and right sides are shifted by a half cycle. When the channel to which the drive timing C is assigned becomes the focused channel, since the drive timings of the channels adjacent thereto on both the left and right sides are the drive timing B and the drive timing D, the phases of the pressure vibrations of the channels adjacent thereto on both the left and right sides are shifted by a half cycle. When the channel to which the drive timing D is assigned becomes the focused channel, since the drive timings of the channels adjacent thereto on both the left and right sides are the drive timing A and the drive timing C, the phases of the pressure vibrations of the channels adjacent thereto on both the left and right sides are shifted by a half cycle.

Figure 19A:
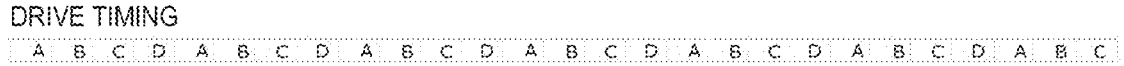
FIGS. 19A and 19B illustrate a matrix in which the drive timings A to D are regularly assigned to channels of the ink jet head, and a matrix indicating a distribution of the delay time of each channel.
Figure 19B:
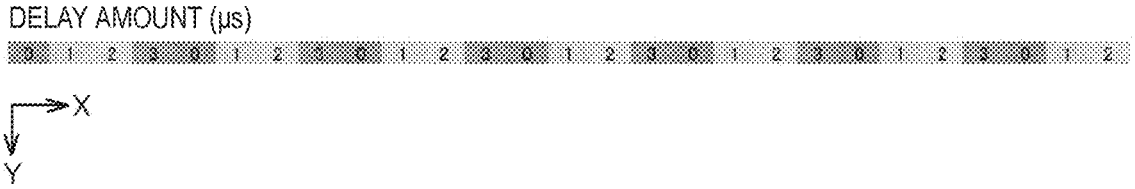

That is, as illustrated in FIG. 19A, even though any one of the channels becomes the focused channel from among the 213 channels to which the drive timings A to D are assigned, the channels adjacent to each other in the left and right direction are set to be driven by the drive waveforms of mutually reversed phases. The channels adjacent to each other in the left and right direction are channels disposed at symmetrical positions when viewed from the focused channel. Therefore, in these channels, the pressure vibrations of the reversed phase in which the vibrations cancel each other out are applied to the focused channel. As a result, when the plurality of channels is driven, influences from the peripheral channels may hardly occur, thereby making it possible to perform stable ink discharge.

Third Embodiment

Figure 20:
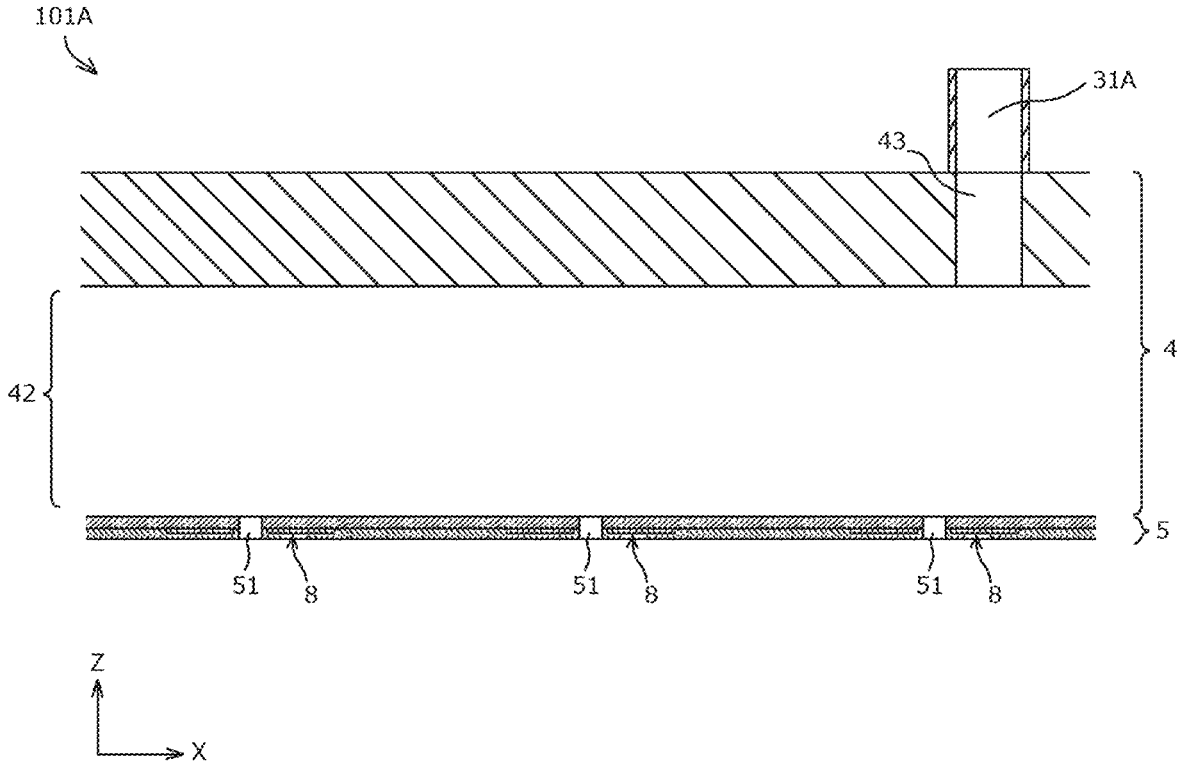
FIG. 20 illustrates a longitudinal cross-sectional view of an ink jet head which is an example of a liquid discharge apparatus according to a third embodiment.

A liquid discharge apparatus according to a third embodiment will be described. FIG. 20 illustrates a longitudinal cross-sectional view of an ink jet head 101A as an example of the liquid discharge apparatus. The inkjet head 101A has the same configuration as that of the ink jet head 1A illustrated in the first embodiment except that the pressure chamber (individual pressure chamber) 41 is omitted and the nozzle plate 5 is set to directly communicate with the common ink chamber 42. Accordingly, the same components as those of FIG. 4 are denoted by the same reference signs, and the detailed descriptions thereof will be omitted.

The ink jet head 101A illustrated in FIG. 20 is also driven by assigning the drive timings A to D as shown in one example of FIG. 16A to all the channels. Further, in the ink jet head 101A, the nozzles 51 may be arranged in a row as in the second embodiment.

According to anyone of the above-described embodiments, the drive timings A to D are assigned as shown in one example of FIGS. 16A and 19A, whereby the channels respectively adjacent to each other in the left and right direction, in the up and down direction, and the like are set to be driven by the drive waveforms of the mutually reversed phases. Accordingly, the channels adjacent to each other apply the pressure vibrations of the reversed phase in which the vibrations cancel each other out to the focused channel which is a channel positioned at the center of the channels adjacent to each other. As a result, the crosstalk in the operations of the actuators can be suppressed, thereby making it possible to perform the stable liquid discharge.

That is, in the ink jet heads 1A, 100A, and 101A, the actuators 8 and the nozzles 51 are disposed on the surface of the nozzle plate 5. In this case, when the plurality of actuators 8 are driven at the same time, since the surface of the nozzle plate 5 is bent and the influence of pressure changes from the surrounding actuators 8 occur via the common ink chamber 42, crosstalk in which the movement of the actuator 8 interferes with the movement of another actuator 8 occurs. Therefore, the crosstalk from the surrounding actuators 8 is suppressed by assigning the drive timing as described above.

Further, in the above-described embodiments, as one example of the liquid discharge apparatus, the ink jet heads 1A, 100A, and 101A of the ink jet printer 10 are described, but the liquid discharge apparatus may be a molding material discharge head of a 3D printer and a sample discharge head of a dispensing apparatus.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A liquid discharge apparatus, comprising:

a nozzle plate including an array of nozzles arranged in a first direction and a plurality of actuators corresponding to the nozzles, respectively, the array including first, second, and third nozzles arranged in the first direction in this order with no nozzle therebetween, and the plurality of actuators including first, second, and third actuators corresponding to the first, second, and third nozzles, respectively; and a drive controller configured to apply a drive signal to the first, second, third actuators during a drive cycle, the drive signal being applied to the first actuator at a timing different from a timing at which the drive signal is applied to the third actuator by an odd number multiple of a half of an inherent vibration cycle of the liquid discharge apparatus, wherein a half wavelength of an inherent vibration of the liquid discharge apparatus along a surface direction of the nozzle plate when the plurality of actuators is driven is greater than an arrangement pitch of the plurality of actuators along the first direction.

2. The liquid discharge apparatus according to claim 1, wherein, during the drive cycle, the drive signal is applied to the second actuator at a timing that is different from the timing for the first actuator and the timing for the third actuator.

3. The liquid discharge apparatus according to claim 1, wherein, during the drive cycle, the drive signal is applied to the second actuator after the drive signal has been applied to the first actuator by a quarter of the inherent vibration cycle, and before the drive signal is applied to the third actuator by the quarter of the inherent vibration cycle.

4. The liquid discharge apparatus according to claim 1, wherein the array of nozzles further includes fourth and fifth nozzles arranged in a second direction different from the first direction, and the fourth, second, and fifth nozzles are arranged in the second direction in this order with no nozzle therebetween, the plurality of actuators further includes fourth and fifth actuators corresponding to the fourth and fifth nozzles, respectively, and the drive controller is further configured to apply the drive signal to the fourth and fifth actuators during the drive cycle, the drive signal being applied to the fourth actuator at a timing different from a timing at which the drive signal is applied to the fifth actuator by an odd number multiple of the half of the inherent vibration cycle.

5. The liquid discharge apparatus according to claim 4, wherein, during the drive cycle, the drive signal is applied to the second actuator at a timing that is different from the timing at which the drive signal is applied to the fourth actuator and the timing at which the drive signal is applied to the fifth actuator.

6. The liquid discharge apparatus according to claim 4, wherein, during the drive cycle, the drive signal is applied to the second actuator after the drive signal is applied to the first actuator by a quarter of the inherent vibration cycle, and before the drive signal is applied to the third actuator by the quarter of the inherent vibration cycle.

7. The liquid discharge apparatus according to claim 4, wherein, during the drive cycle, the drive signal is applied to the first actuator at the same timing as the fourth actuator, and the drive signal is applied to the third actuator at the same timing as the fifth actuator.

8. The liquid discharge apparatus according to claim 1, wherein the array of nozzles further includes fourth and fifth nozzles, and the fourth, first, second, third, and fifth nozzles are arranged in the first direction in this order with no nozzle therebetween, the plurality of actuators further includes fourth and fifth actuators corresponding to the fourth and fifth nozzles, respectively, and the drive controller is further configured to apply the drive signal to the fourth and fifth actuators during the drive cycle, the drive signal being applied to the fourth actuator at a timing different from the timing at which the drive signal is applied to the second actuator by an odd number multiple of the half of the inherent vibration cycle, and the drive signal being applied to the fifth actuator at a timing different from the timing at which the drive signal is applied to the second actuator by an odd number multiple of the half of the inherent vibration cycle.

9. The liquid discharge apparatus according to claim 8, wherein the drive signal is applied to the fourth actuator at the same timing as the fifth actuator.

10. The liquid discharge apparatus according to claim 1, wherein, during the drive cycle, the drive signal is applied to the third actuator after the drive signal has been applied to the second actuator by a quarter of the inherent vibration cycle, and the drive signal is applied to the first actuator after the drive signal has been applied to the third actuator by a half of the inherent vibration cycle.

11. A method for driving a liquid discharge apparatus including:

a nozzle plate including an array of nozzles arranged in a first direction and a plurality of actuators corresponding to the nozzles, respectively, the array including first, second, and third nozzles arranged in the first direction in this order with no nozzle therebetween, and the plurality of actuators including first, second, and third actuators corresponding to the first, second, and third nozzles, respectively, the method comprising, during a drive cycle:

applying a drive signal to the first actuator;

applying the drive signal to the second actuator; and applying the drive signal to the third actuator, wherein the drive signal is applied to the first actuator at a timing different from a timing at which the drive signal is applied to the third actuator by an odd number multiple of a half of an inherent vibration cycle of the liquid discharge apparatus, and a half wavelength of an inherent vibration along a surface direction of the nozzle plate when the plurality of actuators is driven is greater than an arrangement pitch of the plurality of actuator along the first direction.

12. The method according to claim 11, wherein during the drive cycle, the drive signal is applied to the second actuator at a timing that is different from the timing at which the drive signal is applied to the first actuator and the timing at which the drive signal is applied to the third actuator.

13. The method according to claim 11, wherein during the drive cycle, the drive signal is applied to the second actuator after the drive signal is applied to the first actuator by a quarter of the inherent vibration cycle, and before the drive signal is applied to the third actuator by the quarter of the inherent vibration cycle.

14. The method according to claim 11, wherein the array of nozzles further include fourth and fifth nozzles arranged in a second direction different from the first direction, and the fourth, second, and fifth nozzles are arranged in the second direction in this order with no nozzle therebetween, and the plurality of actuators further includes fourth and fifth actuators corresponding to the fourth and fifth nozzles, respectively, the method further comprising, during the drive cycle:

applying the drive signal to the fourth actuators; and applying the drive signal to the fifth actuator, wherein the drive signal is applied to the fourth actuator at a timing different from a timing at which the drive signal is applied to the fifth actuator by an odd number multiple of the half of the inherent vibration cycle.

15. The method according to claim 14, wherein, during the drive cycle, the drive signal is applied to the second actuator at a timing that is different from the timing at which the drive signal is applied to the fourth actuator and the timing at which the drive signal is applied to the fifth actuator.

16. The method according to claim 14, wherein, during the drive cycle, the drive signal is applied to the second actuator after the drive signal has been applied to the first actuator by a quarter of the inherent vibration cycle, and before the drive signal is applied to the third actuator by the quarter of the inherent vibration cycle.

17. The method according to claim 14, wherein, during the drive cycle, the drive signal is applied to the first actuator at a same timing as the fourth actuator, and the drive signal is applied to the third actuator at a same timing as the fifth actuator.

18. The method according to claim 11, wherein the array of nozzles further includes fourth and fifth nozzles, and the fourth, first, second, third, and fifth nozzles are arranged in the first direction in this order with no nozzle therebetween, and the plurality of actuators further includes fourth and fifth actuators corresponding to the fourth and fifth nozzles, respectively, the method further comprising, during the drive cycle:

applying the drive signal to the fourth actuator; and applying the driving signal to the fifth actuator, wherein the drive signal is applied to the fourth actuator at a timing different from the timing at which the drive signal is applied to the second actuator by an odd number multiple of the half of the inherent vibration cycle, and the drive signal is applied to the fifth actuator at a timing that is different from the timing at which the drive signal is applied to the second actuator by an odd number multiple of the half of the inherent vibration cycle.

19. The method according to claim 18, wherein the drive signal is applied to the fourth actuator at a same timing as the fifth actuator.

20. The method according to claim 11, wherein, during the drive cycle, the drive signal is applied to the third actuator after the drive signal has been applied to the second actuator by a quarter of the inherent vibration cycle, and the drive signal is applied to the first actuator after the drive signal has been applied to the third actuator by a half of the inherent vibration cycle.

* * * * *